US007127878B1

(12) United States Patent
Wilke et al.

(10) Patent No.: US 7,127,878 B1
(45) Date of Patent: Oct. 31, 2006

(54) CONTROLLED FAILURE ROPE SYSTEMS AND METHODS

(75) Inventors: Wolfgang Wilke, Surrey (CA); Sigmunt Nowak, Richmond (CA); Danielle D. Stenvers, Ferndale, WA (US); Chia-Te Chou, Bellingham, WA (US)

(73) Assignee: Samson Rope Technologies, Ferndale, WA (US)

( * ) Notice: Subject to any disclaimer, the term of this patent is extended or adjusted under 35 U.S.C. 154(b) by 24 days.

(21) Appl. No.: 10/887,377

(22) Filed: Jul. 7, 2004

Related U.S. Application Data

(60) Provisional application No. 60/530,131, filed on Dec. 16, 2003.

(51) Int. Cl.
*D02G 3/32* (2006.01)

(52) U.S. Cl. ..... 57/231

(58) Field of Classification Search ..... 57/237
See application file for complete search history.

(56) References Cited

U.S. PATENT DOCUMENTS

| | | | | |
|---|---|---|---|---|
| 3,367,095 | A | 2/1968 | Field, Jr. | |
| 3,729,920 | A | 5/1973 | Sayers et al. | |
| 3,762,865 | A | 10/1973 | Weil | |
| 3,839,207 | A | 10/1974 | Weil | |
| 3,906,136 | A | 9/1975 | Weil | |
| 3,957,923 | A | 5/1976 | Burke | |
| 3,977,172 | A * | 8/1976 | Kerawalla | 57/237 |
| 3,979,545 | A | 9/1976 | Braus et al. | |
| 4,031,121 | A | 6/1977 | Brown | |
| 4,155,394 | A * | 5/1979 | Shepherd et al. | 152/527 |
| 4,170,921 | A * | 10/1979 | Repass | 87/6 |
| 4,257,221 | A | 3/1981 | Feinberg | |
| 4,312,260 | A | 1/1982 | Morieras | |
| 4,500,593 | A | 2/1985 | Weber | |
| 4,762,583 | A | 8/1988 | Kaempen | |
| 4,784,918 | A | 11/1988 | Klett et al. | |
| 4,868,041 | A | 9/1989 | Yamagishi et al. | |
| 4,958,485 | A | 9/1990 | Montgomery et al. | |
| 5,501,879 | A | 3/1996 | Murayama | |
| 5,802,839 | A * | 9/1998 | Van Hook | 57/236 |
| 6,164,053 | A | 12/2000 | O'Donnell et al. | |
| 6,295,799 | B1 | 10/2001 | Baranda | |
| 6,365,070 | B1 | 4/2002 | Stowell et al. | |
| 6,410,140 | B1 | 6/2002 | Land et al. | |
| 6,592,987 | B1 | 7/2003 | Sakamoto et al. | |
| 6,601,378 | B1 * | 8/2003 | Fritsch et al. | 57/238 |
| 2005/0172605 | A1 * | 8/2005 | Vancompernolle et al. | 57/237 |

* cited by examiner

*Primary Examiner*—Shaun R. Hurley
(74) *Attorney, Agent, or Firm*—Michael R. Schacht; Schacht Law Office, Inc.

(57) ABSTRACT

A controlled failure rope and method of making the same. The controlled failure rope comprises first and second portions. The first portion is formed of a first material having a first set of tension failure characteristics. The second portion is formed of a second material having a second set of tension failure characteristics. The first and second sets of tension failure characteristics differ such that, when the rope is subjected to tension loads above a tension threshold, the first portion of the rope begins to fail before the second portion of the rope, therefore providing a prior indication of possible rope failure before the rope becomes completed separated.

30 Claims, 3 Drawing Sheets

CONTROLLED FAILURE ROPE SYSTEMS AND METHODS

RELATED APPLICATIONS

This application claims priority of U.S. Provisional Patent Application Ser. No. 60/530,131, which was filed on Dec. 16, 2003.

TECHNICAL FIELD

The present invention relates to rope systems and methods and, in particular, to rope systems in which the failure of the rope under predetermined failure conditions is controlled and to methods of making such rope.

BACKGROUND OF THE INVENTION

The characteristics of a given type of rope determine whether that type of rope is suitable for a specific intended use. Rope characteristics include breaking strength, elongation, flexibility, weight, abrasion resistance, and coefficient of friction. The intended use of a rope will determine the acceptable range for each characteristic of the rope. The term "failure" as applied to rope will be used herein to refer to a rope being subjected to conditions beyond the acceptable range associated with at least one rope characteristic.

The present invention primarily relates to the performance of rope when the rope fails due to excess tension loads. When a rope is subjected to excess tension loads, the rope fails over time in what will be referred to as a tension failure sequence. For the purposes of the following discussion, it will be assumed that a constant tension load is applied to the rope throughout the tension failure sequence. However, a rope of the present invention may be used in situations in which the tension load varies or is eliminated during the tension failure sequence.

The tension failure sequence varies from rope to rope and from environment to environment. In general, a rope or portion of a rope breaks when all of the fibers of the rope separate or break apart at a given location on the rope. If the fibers are all identical, it is conceivable that all of the fibers will break at the same time. Typically, however, individual fibers differ from each other based on such factors as manufacturing variations and wear on the fibers during use of the rope. Accordingly, when the failure sequence begins, the lower elongating fibers will break first, transferring the load to the remaining fibers. As the entire tension load is transferred to the remaining higher elongating fibers, these also begin to break. When all of the fibers have broken at a given location, the rope is broken.

In a conventional rope, the tension failure sequence typically begins with elongation of the rope. After a certain amount of elongation, the rope breaks, marking the end of the tension failure sequence. At the end of the tension failure sequence, the rope exceeds the acceptable range of elongation and eventually breaks. When the rope breaks, potential energy within the rope is converted into kinetic energy that can cause unpredictable movement of the ends of the rope on either side of the break.

The need thus exists for improved ropes that, when subjected to excess tension loads, fail in a controlled manner; the need also exists for systems and methods for controlling the failure of rope and for producing such improved ropes.

SUMMARY OF THE INVENTION

The present invention is a controlled failure rope and method of controlling the failure of a rope. A controlled failure rope of the present invention comprises first and second portions. The first portion is formed of a first material having a first set of tension failure characteristics. The second portion is formed of a second material having a second set of tension failure characteristics. The first and second sets of tension failure characteristics differ such that, when the rope is subjected to tension loads above a tension threshold, the first portion of the rope begins to fail before the second portion of the rope.

The present invention may also be embodied as a method of making a controlled failure rope comprising the following steps. Initially, first and second materials are provided. The first and second materials define first and second sets of tension failure characteristics, respectively. The materials are combined to form a rope comprising first and second portions, where, when the rope is subjected to tension loads above a tension threshold, the first portion of the rope begins to fail before the second portion of the rope.

DETAILED DESCRIPTION OF THE INVENTION

Figure 1:
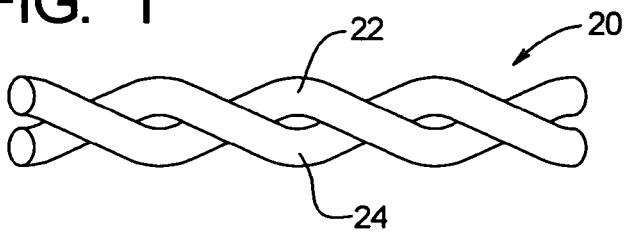
FIG. 1 is a somewhat schematic, perspective view of a controlled failure rope constructed in accordance with, and embodying, the principles of the present invention.

Referring initially to FIG. 1 of the drawing, depicted therein is a controlled failure rope 20 constructed in accordance with, and embodying, the principles of the present invention. The rope 20 comprises at least a first portion 22 of a first material having a first set of tension failure characteristics and a second portion 24 of a second material having a second set of tension failure characteristics.

The first and second portions 22 and 24 are physically combined such that the rope 20 does not fail in a single stage when subjected to excess tension loads. Instead, the properties of the first and second materials and the manner in which the first and second portions 22 and 24 are combined to cause the rope 20 to fail in at least two stages under excess tension loads. As will be described in further detail below, the rope 20 thus has improved performance when failing under excess tension loads as compared to conventional synthetic ropes.

In the rope 20 constructed according to the principles of the present invention, a first stage of the tension failure sequence begins with elongation of the first portion 22. Before or when the first portion 22 breaks, the second portion 24 of the rope 20 elongates, marking the end of the first stage and the beginning of a second stage of the tension failure sequence. When the second portion 24 breaks, the second stage of the tension failure sequence ends.

In the rope 20 comprising only the first and second portions 22 and 24 comprising first and second materials, the end of the second stage marks the end of the entire tension failure sequence. However, it may be possible to employ a third and/or additional portions, each comprised of a material having different tension failure characteristics. In this case, the tension failure sequence may comprise three or more stages.

The term "tension failure characteristics" is used herein to refer to the detectable or measurable changes associated with the tension failure sequence. The tension failure characteristics include:

Load Threshold: the load at which the tension failure sequence begins;

Elongation: the amount of elongation that occurs after the Load Threshold is exceeded and before the rope breaks (axial direction);

Tension Failure Duration: the duration of the tension failure sequence; and

Tension Failure Geometry: changes in shape and/or diameter (radial direction) of the rope or its constituent parts during the tension failure sequence.

When the terms Load Threshold, Elongation, Tension Failure Duration, and Tension Failure Geometry are used without further explanation, these terms refer to tension failure characteristics of a rope as a whole. A rope typically comprises a plurality of individual components, and the terms Load Threshold, Elongation, Tension Failure Duration, and Tension Failure Geometry may also be applied to these individual components or groups of components.

In the example rope 20, the first set of tension failure characteristics meets the operational requirements defined by the intended use of the rope 20. The second set of tension failure characteristics may or may not meet the operational requirements of the rope 20 but differ from first set of tension failure characteristics in at least one aspect.

In particular, in a rope 20 constructed in accordance with the principles of the present invention, the first and second portions 22 and 24 are formed and combined such that the first portion 22 will bear most or all of the tension loads under normal operating conditions. As the tension load on the rope 20 exceeds the Load Threshold associated with the first set of tension failure characteristics, the first portion 22 of the rope 20 begins to deform, marking the beginning of the first stage of the tension failure sequence. Typically, this deformation takes the form of elongation of the first portion 22.

As the first portion 22 of the rope begins to deform, the tension load on the rope 20 is eventually at least partly borne by the second portion 24, and the second portion 24 of the rope also begins to deform. Typically, the deformation of the second portion 24 of the rope 20 also takes the form of elongation.

The first material is selected such that the first portion 22 will break before the second portion 24. The breaking of the first portion 22 marks the end of the first stage and the beginning of the second stage of the tension failure sequence.

After the first portion 22 breaks, the entire tension load on the rope 20 is borne by the second portion 24. At this point, the rope 20 has not completely failed, and the still intact second portion 24 continues to deform. After further deformation, the second portion 24 of the rope 20 eventually also breaks, marking the end of the tension failure sequence.

When the first portion 22 breaks at the end of the first stage of the tension failure sequence, at least a portion of the potential energy introduced into the rope 20 by the tension load is converted to kinetic energy. However, the intact second portion 24 prevents the rope 20 from breaking entirely. In addition, the second portion 24 of the rope 20 absorbs at least a portion of the kinetic energy associated with the breaking of the first portion 22.

The deformation of the second portion 24 of the rope 20 will also increase the Tension Failure Duration of the tension failure sequence associated with the rope 20. Depending upon the size and composition of the rope 20 and the tension load applied thereto, the tension failure sequence can be increased as compared to a conventional rope by from a fraction of a second to ten seconds or more. The look and performance of the tension failure sequence of the rope 20 will thus be significantly different from that of a conventional rope.

The first material forming the first portion 22 of the rope 20 is the lower elongating material and may be any one or more yarns with tenacity greater than approximately 15 grams per denier (gpd) to serve as the strength component. Surface modifications may be accomplished through the blending of other fiber or fibers with the high tenacity strength component to obtain the desired surface characteristics.

The second material forming the second portion 24 of the rope 20 is the higher elongating material and may be any one or more yarns having an elongation that is at least three times greater than the elongation of the yarns forming the first portion 22.

As generally discussed above, the first material 22 bears most of the primary tension loads during normal use (i.e., when the tension loads are below the Load Threshold). The second material 24 thus increases weight of the rope without significantly contributing to the performance of the rope during normal use. Accordingly, the amount of the second material 24 used should be kept as low as possible while still functioning properly during the tension failure sequence.

In particular, the second material 24 should be within a first preferred range of approximately between 1 percent and 40 percent by weight of the rope 20. The second material 24 should be within a second preferred range of approximately between 5 percent and 30 percent by weight of the rope 20.

The following discussion will describe several particular example ropes constructed in accordance with the principles of the present invention as generally discussed above.

EXAMPLE I

Figure 2:
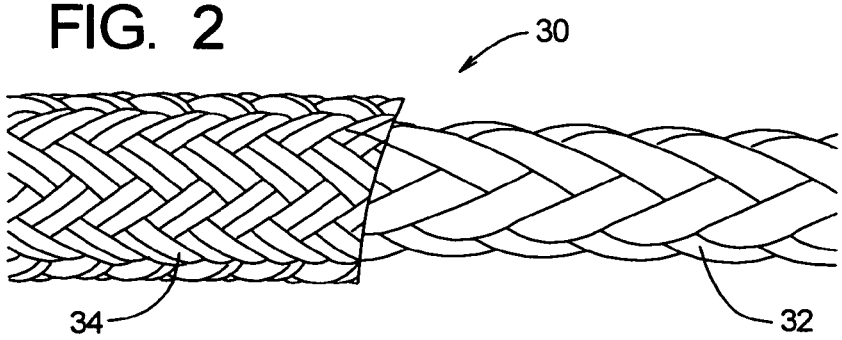
FIG. 2 is a side elevation view of a second example of a controlled failure rope of the present invention.
Figure 3:
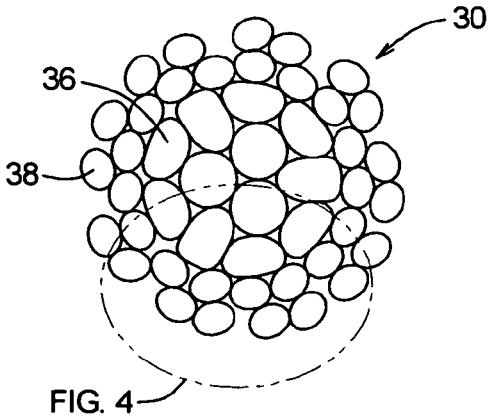
FIG. 3 is a radial cross-section of the controlled failure rope depicted in FIG. 2.
Figure 4:
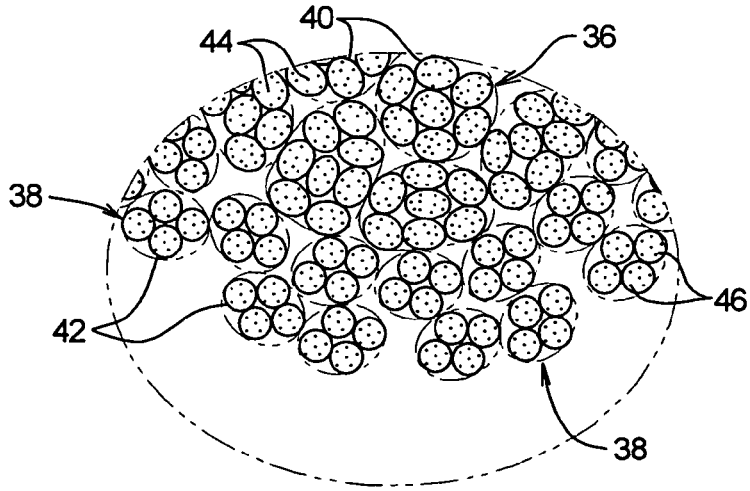
FIG. 4 is a close-up view of a portion of FIG. 3.

Referring now to FIGS. 2, 3, and 4, those figures depict an example of a controlled failure rope 30 constructed in accordance with the principles of the present invention. As shown in FIG. 2, the controlled failure rope 30 comprises a core 32 and a jacket 34. FIG. 2 also shows that the core 32 and jacket 34 comprise a plurality of strands 36 and 38, respectively. FIG. 4 shows that the strands 36 and 38 comprise a plurality of yarns 40 and 42 and that the yarns 40 and 42 in turn each comprise a plurality of fibers 44 and 46, respectively.

The fibers 44 and 46 are the elemental components of the rope 30. The example yarns 40 and 42 are formed of fibers 44 and 46 made of synthetic materials. The fibers 44 and 46 are combined to form the yarns 40 and 42 using any one or more of a number of techniques. The strands 36 and 38 are formed by the combining the yarns 40 and 42, also by using any one or more of a number of techniques. The techniques for combining fibers to form yarns and combing yarns to form strands are or may be conventional and will not be described herein in detail.

The exemplary core 32 and jacket 34 are formed from the yarns 40 and 42 using a braiding process. The example rope 30 is thus the type of rope referred to in the industry as a double-braided synthetic rope.

The example rope 30 comprises first and second portions, which are analogous to the first and second portions 22 and 24 described above. The first and second portions of the example rope 30 are formed using any one or more of several different arrangements. The following Table A lists some of the configurations of the first and second portions of the example rope 30:

TABLE A

| Configuration | first portion | second portion |
|---|---|---|
| 1 | core 32 | jacket 34 |
| 2 | jacket 34 | core 32 |
| 3 | some of the strands 36 of the core 32 | some of the strands 36 of the core 32 and the jacket 34 |
| 4 | the core 32 and some of the strands 38 of the jacket 34 | some of the strands 38 of the jacket 34 |
| 5 | some of the yarns 40 of the strands 38 | some of the yarns 40 of the strands 38 and the jacket 34 |
| 6 | the core 32 and some of the yarns 42 of the strands 38 | some of the yarns 42 of the strands 38 |
| 7 | some of the strands 36 of the yarns 40 and some of the strands 38 of the yarns 40 | some of the strands 36 of the yarns 40 and some of the strands 38 of the yarns 40 |
| 8 | the core 32 and some of the fibers 46 of the jacket 34 | some of the fibers 46 of the jacket 34 |
| 9 | some of the fibers 44 of the yarns 40 | some of the fibers 44 of the yarns 40 and the jacket 34 |
| 10 | some of the fibers 44 of the yarns 40 and some of the fibers 46 of the yarns 42 | some of the fibers 44 of the yarns 40 and some of the fibers 46 of the yarns 42 |

In the configurations in Table A, the strands 36 and yarns 40 may be substantially identical in size and composition. However, strands 36 and yarns 40 of different sizes and compositions may be combined to form the core 32. Similarly, the strands 38 and yarns 42 of the jacket 32 may be substantially identical in size and composition, although strands 38 and yarns 42 of different sizes and compositions may be combined to form the jacket 34.

EXAMPLE 2

Figure 5:
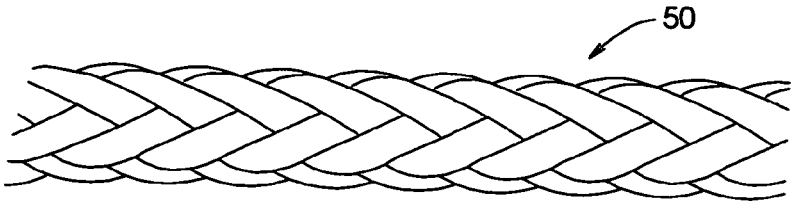
FIG. 5 is a side elevation view of a third example of a controlled failure rope of the present invention.
Figure 6:
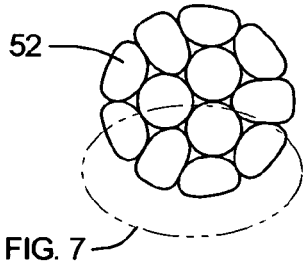
FIG. 6 is a radial cross-section of the controlled failure rope depicted in FIG. 5.
Figure 7:
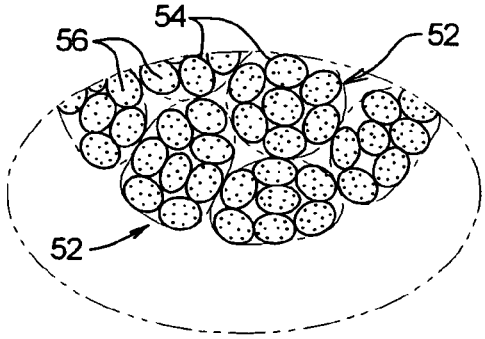
FIG. 7 is a close-up view of a portion of FIG. 6.

Referring now to FIGS. 5, 6, and 7, those figures depict another example of a controlled failure rope 50 constructed in accordance with the principles of the present invention. As perhaps best shown in FIG. 6, the controlled failure rope 50 comprises a plurality of strands 52. FIG. 7 further illustrates that each of the strands 52 comprises a plurality of yarns 54 and that the yarns 54 in turn comprise a plurality of fibers 56.

The fibers 56 are the elemental components of the rope 50. The fibers 56 are combined to form the strands 52 using any one or more of a number of techniques. The example yarns 54 are formed of fibers 56 made of synthetic materials. The strands 52 are formed by combining the yarns 54 using any one of a number of processes. The exemplary rope 50 is formed from the strands 52 using a braiding process. The example rope 50 is thus the type of rope referred to in the industry as a twelve-strand braided synthetic rope.

The example rope 50 comprises first and second portions, which are analogous to the first and second portions 22 and 24 described above. The first and second portions of the example rope 50 are formed using any one or more of several different arrangements. The following Table B lists some of the configurations of the first and second portions of the example rope 50:

TABLE B

| Configuration | first portion | second portion |
|---|---|---|
| 1 | some of the strands 52 | some of the strands 52 |
| 2 | some of the yarns 54 | some of the yarns 54 |
| 3 | some of the fibers 56 | some of the fibers 56 |

In the configurations in Table B, the strands 52 forming the rope 50 may be substantially identical in size, but at least some of them must be different in composition. However, strands 52 of different sizes may be combined to form the rope 50. One form of the example rope 50 may comprise eighty percent by weight of the first portion and twenty percent by weight of the second portion.

EXAMPLE 3

Figure 8:
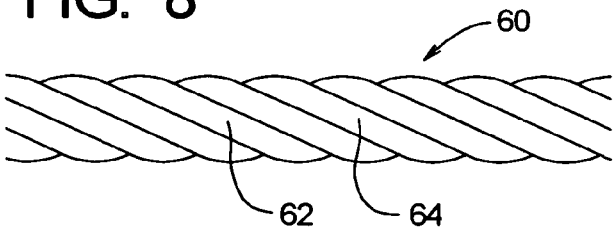
FIG. 8 is a side elevation view of a fourth example of a controlled failure rope of the present invention.
Figure 9:
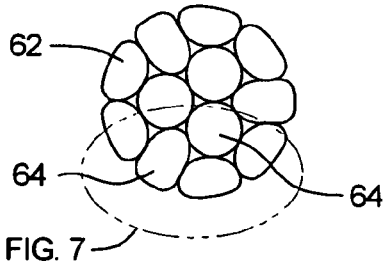
FIG. 9 is a radial cross-section of the controlled failure rope depicted in FIG. 8.
Figure 10:
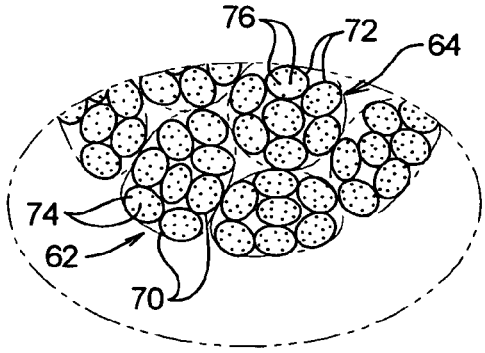
FIG. 10 is a close-up view of a portion of FIG. 9.

Referring now to FIGS. 8, 9, and 10, those figures depict yet another example of a controlled failure rope 60 constructed in accordance with the principles of the present invention. As perhaps best shown in FIG. 8, the controlled failure rope 60 comprises a plurality of strands 62 and 64. FIG. 9 further illustrates that each of the strands 62 and 64 in turn comprises a plurality of yarns 70 and 72, respectively, and that the yarns 70 and 72 are in turn comprised of a plurality of fibers 74 and 76, respectively.

The fibers 74 and 76 are the elemental components of the rope 60. The example strands 62 and 64 are formed of fibers 74 and 76 made of synthetic materials. The fibers 74 and 76 are combined to form the yarns 70 and 72 using any one or more of a number of techniques. The yarns 70 and 72 are in turn combined into the strands 62 and 64 using known techniques. The exemplary rope 60 is formed from the strands 62 and 64 using a twisting process. The example rope 60 is thus the type of rope referred to in the industry as an eight-strand twisted rope.

The example rope 60 comprises first and second portions, which are analogous to the first and second portions 22 and 24 described above. The first and second portions of the example rope 60 are formed using any one or more of several different arrangements. The following Table C lists some of the configurations of the first and second portions of the example rope 60:

TABLE C

| Configuration | first portion | second portion |
|---|---|---|
| 1 | the strands 62 | the strands 64 |
| 2 | some of the strands 62 | some of the strands 62 and the strands 64 |
| 3 | the strands 62 and some of the strands 64 | some of the strands 64 |
| 4 | some of the strands 62 and some of the strands 64 | some of the strands 62 and some of the strands 64 |
| 5 | the strands 62 and some of the yarns 72 | some of the yarns 72 |
| 6 | some of the yarns 70 | the strands 64 and some of the yarns 70 |
| 7 | some of the yarns 70 and some of the yarns 72 | some of the strands 70 and some of the yarns 72 |
| 8 | the strands 62 and some of the fibers 76 | some of the fibers 76 |
| 9 | some of the fibers 74 | the strands 64 and some of the fibers 74 |
| 10 | some of the fibers 74 and some of the fibers 76 | some of the fibers 74 and some of the fibers 76 |

In the configurations in Table C, the strands 62 and 64 forming the rope 60 may be substantially identical in size, but at least some of them must be different in composition. However, strands 62 and 64 of different sizes may be combined to form the rope 60. One form of the example rope 60 may comprise eighty percent by weight of the first portion and twenty percent by weight of the second portion.

EXAMPLE 4

Figure 11:
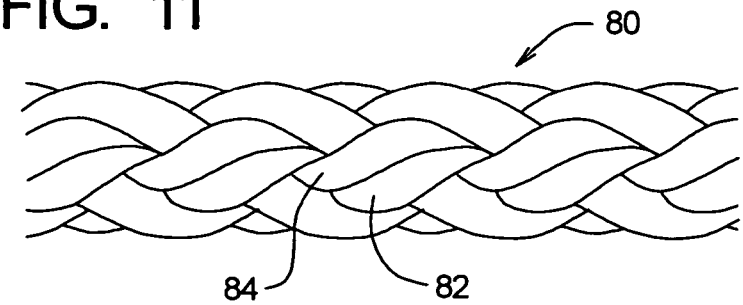
FIG. 11 is a side elevation view of a fifth example of a controlled failure rope of the present invention.
Figure 12:
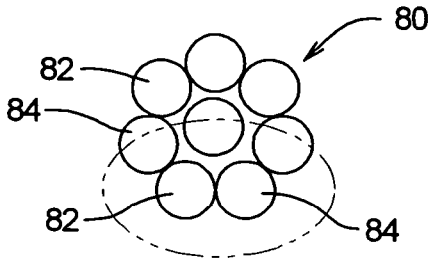
FIG. 12 is a radial cross-section of the controlled failure rope depicted in FIG. 11.
Figure 13:
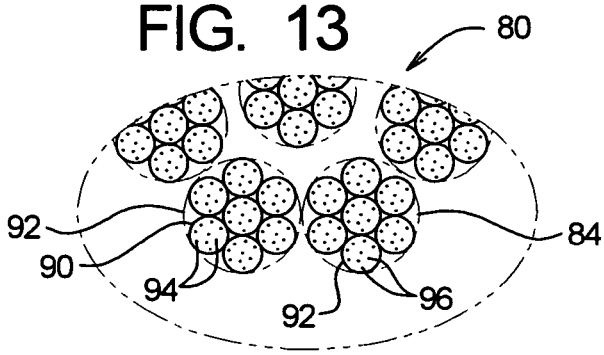
FIG. 13 is a close-up view of a portion of FIG. 12.

Referring now to FIGS. 11, 12, and 13, those figures depict still another example of a controlled failure rope 80 constructed in accordance with the principles of the present invention. As perhaps best shown in FIG. 12, the controlled failure rope 80 comprises a plurality of strands 82 and 84. FIG. 13 further illustrates that each of the strands 82 and 84 in turn comprises a plurality of yarns 90 and 92, respectively, and that the yarns 90 and 92 are in turn comprised of a plurality of fibers 94 and 96, respectively.

The fibers 94 and 96 are the elemental components of the rope 80. The example strands 82 and 84 are formed of fibers 94 and 96 made of synthetic materials. The fibers 94 and 96 are combined to form the yarns 90 and 92 using any one or more of a number of techniques. The yarns 90 and 92 are in turn combined into the strands 82 and 84 using known techniques. The exemplary rope 80 is formed from the strands 82 and 84 using a braiding process. The example rope 80 is thus the type of rope referred to in the industry as an eight-strand braided synthetic rope.

The example rope 80 comprises first and second portions, which are analogous to the first and second portions 22 and 24 described above. The first and second portions of the example rope 80 are formed using any one or more of several different arrangements. The following Table D lists some of the configurations of the first and second portions of the example rope 80:

TABLE D

| Configuration | first portion | second portion |
|---|---|---|
| 1 | the strands 82 | the strands 84 |
| 2 | some of the strands 82 | some of the strands 82 and the strands 84 |

TABLE D-continued

| Configuration | first portion | second portion |
|---|---|---|
| 3 | the strands 82 and some of the strands 84 | some of the strands 84 |
| 4 | some of the strands 82 and some of the strands 84 | some of the strands 82 and some of the strands 84 |
| 5 | the strands 82 and some of the yarns 92 | some of the yarns 92 |
| 6 | some of the yarns 90 | the strands 84 and some of the yarns 90 |
| 7 | some of the yarns 90 and some of the yarns 92 | some of the strands 90 and some of the yarns 92 |
| 8 | the strands 82 and some of the fibers 96 | some of the fibers 96 |
| 9 | some of the fibers 94 | the strands 84 and some of the fibers 94 |
| 10 | some of the fibers 94 and some of the fibers 96 | some of the fibers 94 and some of the fibers 96 |

In the examples in Table D, the strands 82 and 84 forming the rope 80 may be substantially identical in size, but at least some of them must be different in composition. However, strands 82 and 84 of different sizes may be combined to form the rope 80. One form of the example rope 80 may comprise eighty percent by weight of the first portion and twenty percent by weight of the second portion.

EXAMPLE 5

Figure 14:
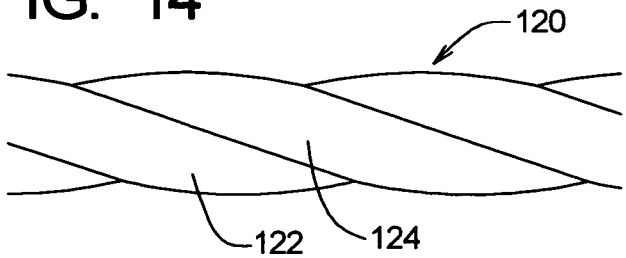
FIG. 14 is a side elevation view of another example of a controlled failure rope of the present invention.
Figure 15:
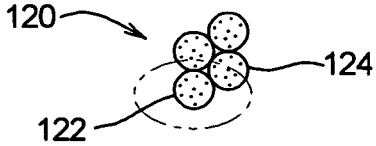
FIG. 15 is a radial cross-section of the controlled failure rope depicted in FIG. 14.
Figure 16:
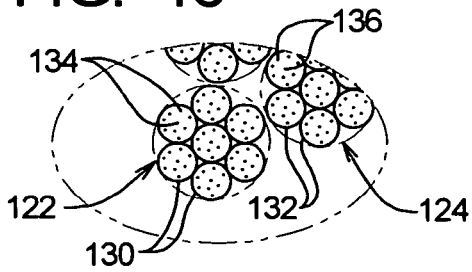
FIG. 16 is a close-up view of a portion of FIG. 15.

Referring now to FIGS. 8, 9, and 10, those figures depict yet another example of a controlled failure rope 120 constructed in accordance with the principles of the present invention. As perhaps best shown in FIG. 14, the controlled failure rope 120 comprises a plurality of strands 122 and 124. FIG. 15 further illustrates that each of the strands 122 and 124 in turn comprises a plurality of yarns 130 and 132, respectively, and that the yarns 130 and 132 are in turn comprised of a plurality of fibers 134 and 136, respectively.

The fibers 134 and 136 are the elemental components of the rope 120. The example strands 122 and 124 are formed of fibers 134 and 136 made of synthetic materials. The fibers 134 and 136 are combined to form the yarns 130 and 132 using any one or more of a number of techniques. The yarns 130 and 132 are in turn combined into the strands 122 and 124 using known techniques. The exemplary rope 120 is formed from the strands 122 and 124 using a twisting process. The example rope 120 is thus the type of rope referred to in the industry as a four-strand twisted rope.

The example rope 120 comprises first and second portions, which are analogous to the first and second portions 22 and 24 described above. The first and second portions of the example rope 120 are formed using any one or more of several different arrangements. The following Table C lists some of the configurations of the first and second portions of the example rope 120:

TABLE E

| Configuration | first portion | second portion |
|---|---|---|
| 1 | the strands 122 | the strands 124 |
| 2 | some of the strands 122 | some of the strands 122 and the strands 124 |
| 3 | the strands 122 and some of the strands 124 | some of the strands 124 |

TABLE E-continued

| Configuration | first portion | second portion |
|---|---|---|
| 4 | some of the strands 122 and some of the strands 124 | some of the strands 122 and some of the strands 124 |
| 5 | the strands 122 and some of the yarns 132 | some of the yarns 132 |
| 6 | some of the yarns 130 | the strands 124 and some of the yarns 130 |
| 7 | some of the yarns 130 and some of the yarns 132 | some of the strands 130 and some of the yarns 132 |
| 8 | the strands 122 and some of the fibers 136 | some of the fibers 136 |
| 9 | some of the fibers 134 | the strands 124 and some of the fibers 134 |
| 10 | some of the fibers 134 and some of the fibers 136 | some of the fibers 134 and some of the fibers 136 |

In the configurations in Table C, the strands 122 and 124 forming the rope 120 may be substantially identical in size, but at least some of them must be different in composition. However, strands 122 and 124 of different sizes may be combined to form the rope 120. One form of the example rope 120 may comprise eighty percent by weight of the first portion and twenty percent by weight of the second portion.

Given the foregoing, it should be clear to one of ordinary skill in the art that the present invention may be embodied in other forms that fall within the scope of the present invention.

What is claimed is:

1. A rope that fails in a predetermined manner when subjected to tension loads, comprising:

a first material having a first set of tension failure characteristics, where the first material is combined into a first set of yarns that are combined into a first set of strands; and a second material having a second set of tension failure characteristics, where the second material is combined into a second set of yarns that are combined into a second set of strands; wherein the first and second sets of strands are combined to form the rope;

the rope operates in a normal mode when the tension loads on the controlled failure rope are under a first tension threshold, where the first set of strands forms a primary strength component of the rope when the rope is operating in the normal mode, in a first stage of a failure sequence when the tension loads on the rope are above the first tension threshold and below a second tension threshold, where the material forming the first strands noticeably deforms in the first stage of the failure sequence;

in a second stage of the failure sequence when the tension loads on the rope are above the second tension threshold, where the material forming the first set of strands fails and the second set of strands forms the primary strength component of the rope when the rope is operating in the second stage of the failure sequence; and the first tension threshold is below the second tension threshold.

2. A rope as recited in claim 1, in which the first and second sets of tension failure characteristics include load threshold, elongation, tension failure duration, and tension failure geometry.

3. A rope as recited in claim 1, in which at least one difference between the first and second sets of tension failure characteristics results in a visible change in the rope the when the rope is operating in the failure sequence.

4. A rope as recited in claim 1, in which a load threshold of the material forming the first set of strands is lower than a load threshold of the material forming the second set of strands.

5. A rope as recited in claim 1, in which an elongation of material forming the second set of strands is at least three times an elongation of the material forming the first set of strands.

6. A rope as recited in claim 1, in which the second material comprises substantially between one percent and forty percent by weight of the rope.

7. A rope as recited in claim 1, in which the second material comprises substantially between five percent and thirty percent by weight of the rope.

8. A rope as recited in claim 1, in which the rope is a double braided rope.

9. A rope as recited in claim 1, in which the rope comprises a core and a jacket.

10. A rope as recited in claim 1, in which the rope is a braided rope.

11. A rope as recited in claim 10, in which the rope comprises twelve strands.

12. A rope as recited in claim 10, in which the rope comprises eight strands.

13. A rope as recited in claim 10, in which the rope comprises four strands.

14. A rope as recited in claim 1, in which the rope is a twisted rope.

15. A rope as recited in claim 1, in which a tenacity of the first material is greater than approximately fifteen grams per denier.

16. A method of forming a rope having controlled failure characteristics when subjected to tension loads above a first tension threshold, the method comprising the steps of:

providing a first rope material, where the first rope material defines a first set of tension failure characteristics;

providing a second rope material, where the second rope material defines a second set of tension failure characteristics, where a load threshold of the first portion of the rope is lower than a load threshold of the second portion of the rope;

forming a first set of yarns from the first material;

forming a first set of strands from the first set of yarns;

forming a second set of yarns from the second material;

forming a second set of strands from the second set of yarns;

combining the first and second sets of strands to form the rope such that when the rope is subjected to tension loads below the first tension threshold, the first set of strands forms a primary strength component of the rope under tension loads; and when the rope is subjected to tension loads above the first tension threshold and below a second tension threshold, the first material used to form the first set of strands noticeably deforms; and when the rope is subjected to tension loads above the second tension threshold, the material forming the first set of strands fails and the second set of strands forms the Primary strength component of the rope under tension loads.

17. A method as recited in claim 16, in which the first and second sets of tension failure characteristics include load threshold, elongation, tension failure duration, and tension failure geometry.

18. A method as recited in claim 16, further comprising the step of selecting the first and second materials such that a change in the rope is visible the when the rope is subjected to tension loads above a first tension threshold.

19. A method as recited in claim 16, further comprising the step of selecting the first and second materials such that a load threshold of the first material is lower than a load threshold of the second material.

20. A method as recited in claim 16, further comprising the step of selecting the first and second materials such that an elongation of the material forming the second set of strands is at least three times an elongation of the material forming the first set of strands.

21. A method as recited in claim 16, in which second material comprises substantially between one percent and forty percent by weight of the rope.

22. A method as recited in claim 16, in which the second material comprises substantially between five percent and thirty percent by weight of the rope.

23. A method as recited in claim 16, in which the rope is a double braided rope.

24. A method as recited in claim 16, in which the rope comprises a core and a jacket.

25. A method as recited in claim 16, in which the rope is a braided rope.

26. A method as recited in claim 25, in which the rope comprises twelve strands.

27. A method as recited in claim 25, in which the rope comprises eight strands.

28. A method as recited in claim 25, in which the rope comprises four strands.

29. A method as recited in claim 16, in which the rope is a twisted rope.

30. A method as recited in claim 16, in which a tenacity of the first material is greater than approximately fifteen grams per denier.

* * * * *